US011402170B2

(12) United States Patent
Gurule

(10) Patent No.: US 11,402,170 B2
(45) Date of Patent: Aug. 2, 2022

(54) MONOLITHIC CLAMP BODY FOR FITTING MOUNTING RAIL TO AIR RIFLE

(71) Applicant: FALCON INDUSTRIES, INC., Moriarty, NM (US)

(72) Inventor: William Gurule, Moriarty, NM (US)

(73) Assignee: FALCON INDUSTRIES, INC., Moriarty, NM (US)

( * ) Notice: Subject to any disclaimer, the term of this patent is extended or adjusted under 35 U.S.C. 154(b) by 300 days.

(21) Appl. No.: 16/843,812

(22) Filed: Apr. 8, 2020

(65) Prior Publication Data

US 2021/0318092 A1 Oct. 14, 2021

(51) Int. Cl.
*F41A 21/48* (2006.01)

(52) U.S. Cl.
CPC ..... *F41A 21/487* (2013.01); *F41A 21/485* (2013.01)

(58) Field of Classification Search
CPC ..... F41A 21/485; F41A 21/487
USPC ..... 42/85, 90
See application file for complete search history.

(56) References Cited

U.S. PATENT DOCUMENTS 4,299,044 A * 11/1981 Johannsen ..... F41G 11/003 42/127
D270,748 S * 9/1983 Bechtel ..... F41G 11/004 D22/110
5,107,612 A * 4/1992 Bechtel ..... F41G 11/003 42/146
D394,096 S * 5/1998 Edgar ..... F41A 5/28 D22/108
8,393,108 B1 * 3/2013 Wilson ..... F41G 11/003 42/111
8,397,419 B2 * 3/2013 Williams ..... F41G 11/003 42/90
2011/0131859 A1 * 6/2011 Lawson ..... F41G 11/004 42/90
2014/0047755 A1 * 2/2014 McClintock ..... F41C 27/00 42/90
2014/0157644 A1 * 6/2014 Jiminez ..... F41G 11/003 42/114
2015/0253090 A1 * 9/2015 Kirchhoff ..... F41G 11/001 42/71.01
2016/0178299 A1 * 6/2016 Cassels ..... F41A 5/28 89/193
2018/0164077 A1 * 6/2018 Hancosky ..... F41G 11/003

FOREIGN PATENT DOCUMENTS

DE 202013007206 U1 * 10/2013 ..... F41G 11/003

* cited by examiner

*Primary Examiner* — Bret Hayes
(74) *Attorney, Agent, or Firm* — Loza & Loza LLP; Richard H. Krukar

(57) ABSTRACT

A mounting rail can be added to an air rifle by clamping a clamp to the air cylinder of the air rifle. The clamp has a monolithic clamp body that includes the mounting rail, a base, a left jaw and a right jaw. The left and right jaws are attached to the base. A clamp actuator can draw the jaws together to clamp onto the air cylinder. The base can include a mounting rail such as a Picatinny rail. As such, clamping the monolithic clamp body onto the air cylinder adds a mounting rail to the air rifle.

20 Claims, 10 Drawing Sheets

MONOLITHIC CLAMP BODY FOR FITTING MOUNTING RAIL TO AIR RIFLE

FIELD OF THE INVENTION

Embodiments are related to air rifles, mounting rails, clamps, and more specifically to monolithic clamp bodies for fitting mounting rails to air rifles.

BACKGROUND

Air rifles are well known device that use compressed air to shoot a projectile. Many air rifles have air cylinders located directly under the barrel and attached to the forward end of the receiver. The air cylinders are the compressed air sources used to shoot projectiles from the air rifles. Shooters often rest the air cylinder on a surface to thereby gain stability. The air cylinder, however, can be an awkward shooting rest. Some manufacturers provide for mounting bipods to the front of the receiver, often extending the receiver forward to provide a forward mounting point for the bipod. Other accessories, such as laser pointers and flashlights, generally cannot be attached to those extended receivers. More convenient and flexible systems and methods for attaching bipods and other accessories to air rifles are needed.

BRIEF SUMMARY

The following summary is provided to facilitate an understanding of some of the innovative features unique to the embodiments and is not intended to be a full description. A full appreciation of the various aspects of the embodiments can be gained by taking the entire specification, claims, drawings, and abstract as a whole.

It is therefor an aspect of the embodiments that a system can provide flexibility and convenience to air rifles by adding a mounting rail to which accessories, such as a bipod, can be attached. The system can include a monolithic clamp body comprising a left jaw, a right jaw, a base, and a mounting rail. The monolithic clamp body is configured to clamp the mounting rail to an air cylinder of an air rifle, the air cylinder having a cylinder diameter. A clamp actuator can be configured to tighten the monolithic clamp body on the air cylinder of the air rifle. The left jaw can comprise a left leg, a left arc, and a left end. The left leg is attached to the base. The left arc is attached to the left leg. The left arc terminates at the left end. The right jaw can comprise a right leg, a right arc, and a right end. The right leg is attached to the base. The right arc is attached to the right leg. The right arc terminates at the right end. A lower slot is between the left leg and the right leg. A top gap is between the left end and the right end. A diametrical separation between the left arc and the right arc is greater than the cylinder diameter when the clamp body is relaxed. The clamp body is relaxed when the clamp actuator is not exerting force on the clamp body to thereby cause the top gap to narrow.

It can be another aspect of the embodiments that the clamp actuator comprises a screw that passes through a clear hole in the right leg and is threaded into a threaded hole in the left leg, wherein tightening the screw causes the top gap to narrow. The jaws clamp onto the air cylinder as the top gap narrows. A bipod can be attached to the mounting rail thereby attaching the bipod to the air rifle when the monolithic clamp body is clamped onto the air cylinder of the air rifle.

It can be yet another aspect of the embodiments that the base comprises the mounting rail. The mounting rail can be a picatinny rail. The picatinny rail is a mounting rail specified by MIL-STD-1913 by the United States Department of Defense. There are numerous commercially available bipods and other accessories configured to be attached to Picatinny rails or other standardized firearm mounting rails.

It can be a further aspect of the embodiments that the monolithic clamp body comprises an extrusion profile and a length. Having an extrusion profile does not limit the embodiments to being formed using an extrusion process but does indicate that a step in forming the monolithic clamp body may be an extrusion step. Steps subsequent to an extrusion step can include machining the mounting rail, drilling holes, and tapping holes. For example, the grooves, also called recoil grooves, of a Picatinny can be machined out of an extruded monolithic clamp body. Alternatively, the monolithic clamp body can be molded, can be machined, can be produced by other processes, or can be produced by combinations of processes. The key aspect is the clamp body is monolithic, meaning that it is one piece and is not a plurality of pieces attached to one another by fasteners. The monolithic clamp body can be plastic or aluminum.

The extrusion profile can be symmetric about a vertical axis. The monolithic clamp body and the extrusion profile can have a left top flat and a right top flat that are perpendicular to the vertical axis. The monolithic clamp body and the extrusion profile can have a left flat and a right flat that are parallel to the vertical axis. The lines and curves of an extrusion profile are the surfaces of a body having the extrusion profile. For example, in computer aided design (CAD) it is common for a two-dimensional profile to be drawn and for a three-dimensional CAD solid body to be extruded from the two-dimensional profile. The result of CAD can be a CAD file. A physical part can thereafter be produced from the CAD file.

It can be a still further aspect of the embodiments that the left top flat and the right top flat are perpendicular to the vertical axis and are configured to be below a top surface of the air cylinder. As such, the clamp body can remain clear of the air rifle barrel. The right flat and the left flat can have a plurality of threaded mounting holes. The top gap can be diametrically opposed to the base. As such, the base can be at the bottom of the clamp body while the top gap is at the top of the clamp body.

As discussed above, the lines and curves of the extrusion profile can correspond to surfaces of the monolithic clamp body. The left inner curve of the left jaw profile can be a section of circle. Similarly, the right inner curve of the right jaw profile can also be a section of the circle. Sections of circles in the profile become cylindrical sectors. As such, the monolithic clamp body can comprise a left cylindrical sector and a right cylindrical sector diametrically opposed to the left cylindrical sector. The left jaw comprises the left cylindrical sector. The right jaw comprises the right cylindrical sector. Tightening the screw or clamp actuator can therefore draw the left cylindrical sector and the right cylindrical sector into contact with the air cylinder of an air rifle.

It can be an additional aspect of the embodiments that the extrusion profile comprises a left jaw, a right jaw, and a base, The left jaw can comprise a left leg, a left arc, and a left end, the left leg attached to the base, the left arc attached to the left leg, and the left arc terminating at the left end. The right jaw can comprise a right leg, a right arc, and a right end, the right leg attached to the base, the right arc attached to the right leg, and the right arc terminating at the right end. There can be a lower slot between the left leg and the right leg. There can be a top gap between the left end and the right end. A diametrical separation between the left arc and the right arc can greater than the air cylinder diameter when the monolithic clamp body is relaxed.

BRIEF DESCRIPTION OF THE DRAWINGS

The accompanying figures, in which like reference numerals refer to identical or functionally similar elements throughout the separate views and which are incorporated in and form a part of the specification, further illustrate the present invention and, together with the background of the invention, brief summary of the invention, and detailed description of the invention, serve to explain the principles of the present invention.

DESCRIPTION

The particular values and configurations discussed in these non-limiting examples can be varied and are cited merely to illustrate at least one embodiment and are not intended to limit the scope thereof. In general, the figures are not to scale.

Figure 1:
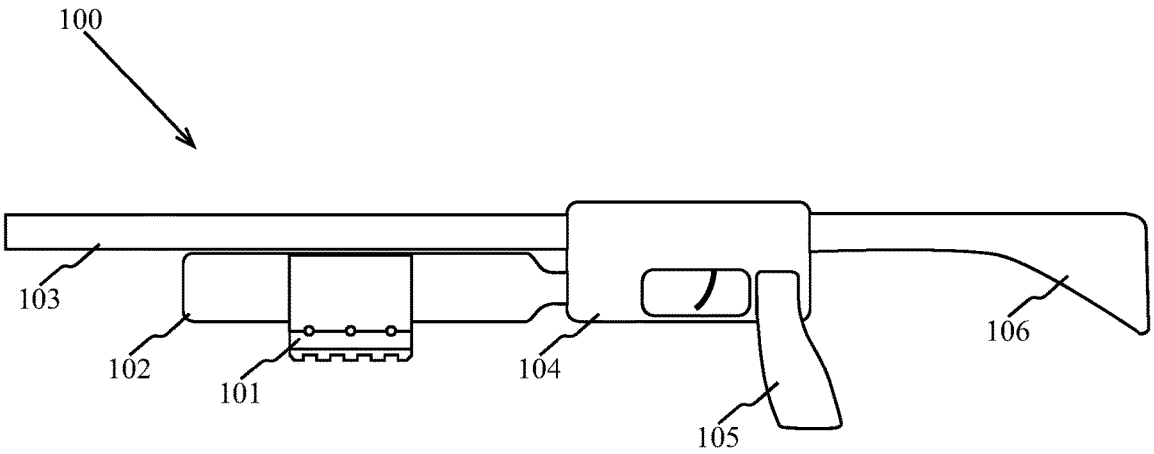
FIG. 1 illustrates a monolithic clamp body clamped on a 60 mm air cylinder of an air rifle, in accordance with aspects of the embodiments.
Figure 2:
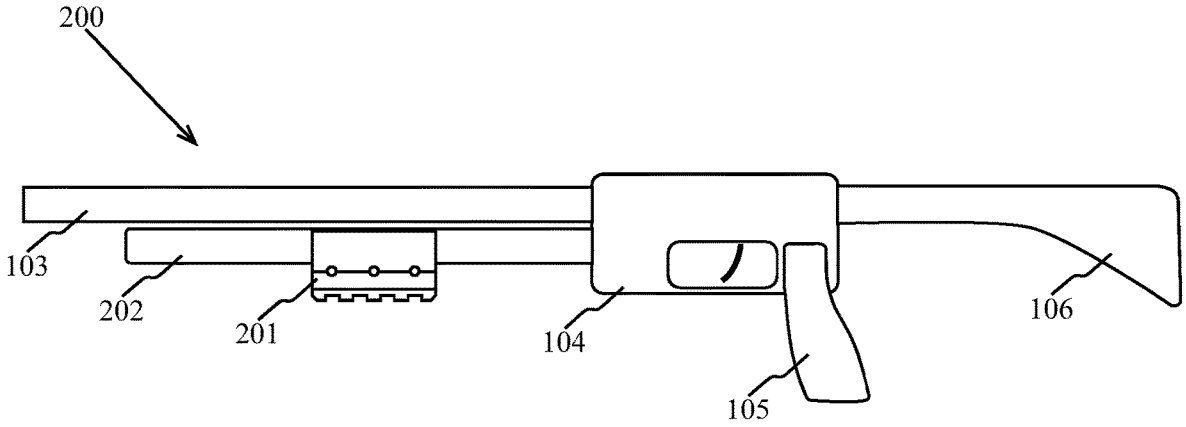
FIG. 2 illustrates a monolithic clamp body clamped on a 30 mm air cylinder of an air rifle, in accordance with aspects of the embodiments.

FIG. 1 illustrates a monolithic clamp body 101 clamped on a 60 mm air cylinder 102 of an air rifle 100, in accordance with aspects of the embodiments. FIG. 2 illustrates a monolithic clamp body 201 clamped on a 30 mm air cylinder 202 of an air rifle 200, in accordance with aspects of the embodiments. Many air rifles have air cylinders mounted as shown in FIGS. 1-2 and the industry has substantially standardized on two air cylinder diameters, 60 mm and 30 mm. In practice, the 60 mm air cylinders have a cylinder diameter that is usually between 60 mm and 64 mm. The 30 mm air cylinders have a cylinder diameter that is usually between 30 mm and 34 mm. The air rifles 100, 200 have a barrel 103, a receiver 104, a grip 105, and a stock 106. The air cylinders 102, 202 are attached to the forward end of the receiver 104.

Figure 3:
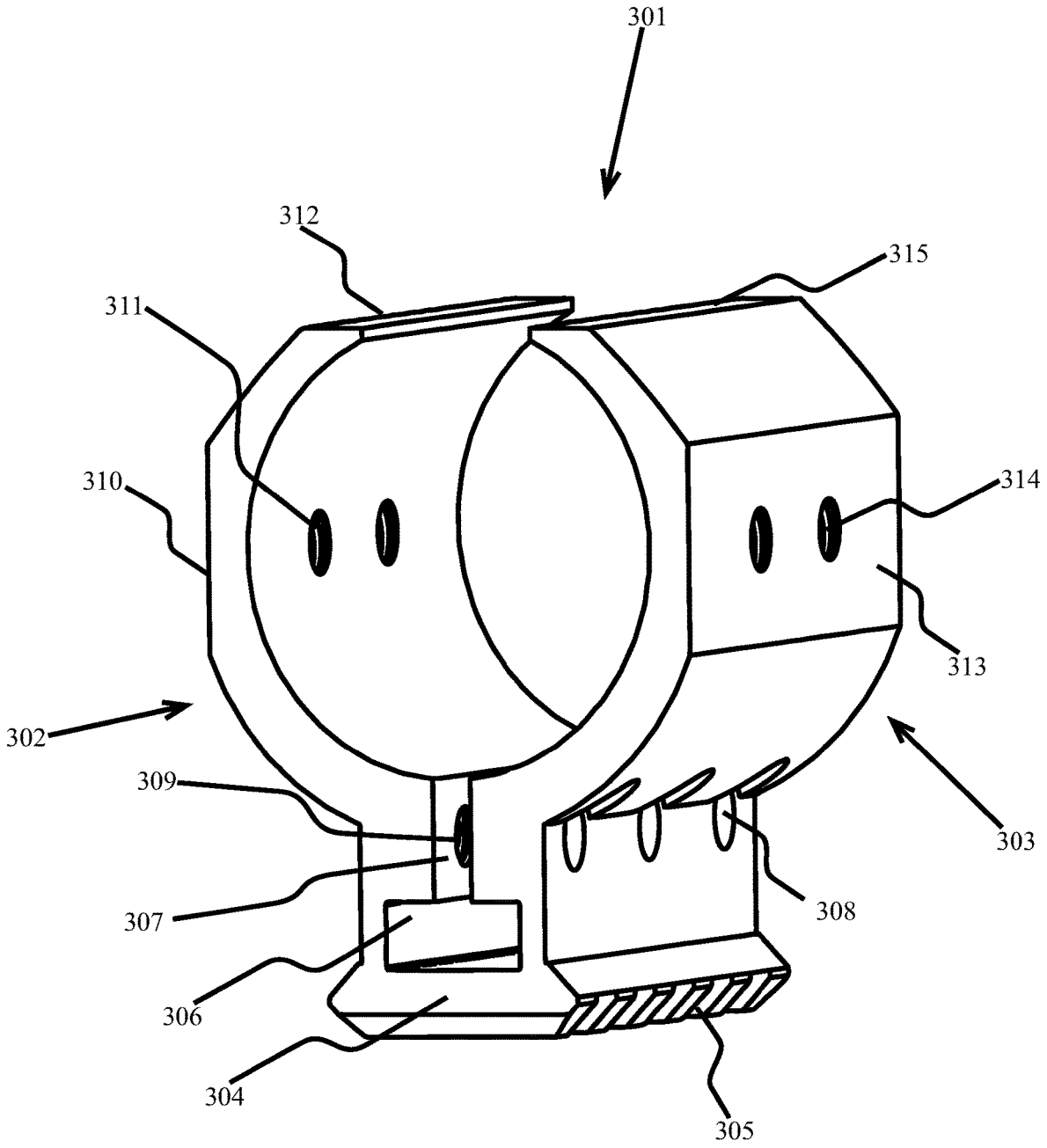
FIG. 3 illustrates a monolithic clamp body from behind and to the right, in accordance with aspects of the embodiments.

FIG. 3 illustrates a monolithic clamp body 301 from behind and to the right, in accordance with aspects of the embodiments. The monolithic clamp body 301 has a left jaw 302 and a right jaw 303 attached to a base 304. A mounting rail 305, here a Picatinny rail, is formed as a part of the base. A gap 307 separates the leg of the left jaw 302 from the leg of the right jaw 303. A lower cavity 306 is directly above the base 304 and between the legs of the jaws 302, 303. The right leg is illustrated with three clear holes 308 while the left leg is illustrated with three threaded holes 309. Only one of the three threaded holes is visible in FIG. 3. The left jaw has a left flat 310 and a left top flat 312. The right jaw has a right flat 313 and a right top flat 315. Mounting holes 311, 314 are threaded holes in the jaws that provide for attaching devices or additional mounting rails to the monolithic clamp body. The left flat 310 has left flat mounting holes 311. The right flat has right flat mounting holes 314.

Figure 4:
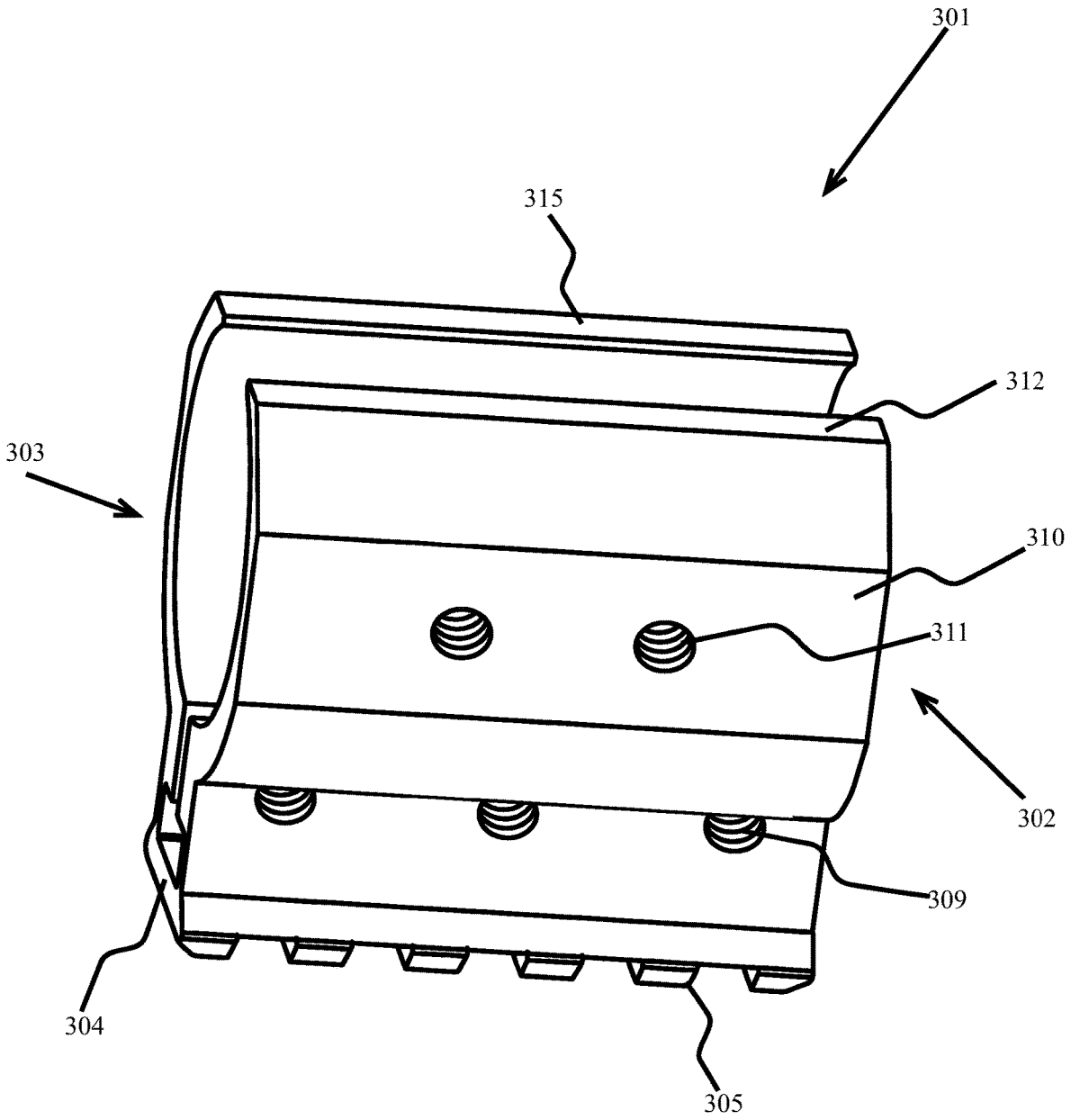
FIG. 4 illustrates the monolithic clamp body of FIG. 3 from the left and above, in accordance with aspects of the embodiments.

FIG. 4 illustrates the monolithic clamp body 301 of FIG. 3 from the left and above, in accordance with aspects of the embodiments. In this view, it can be seen that the left leg is illustrated with three threaded holes 309. The threads in the left flat mounting holes 311 are also clearly visible.

Figure 5:
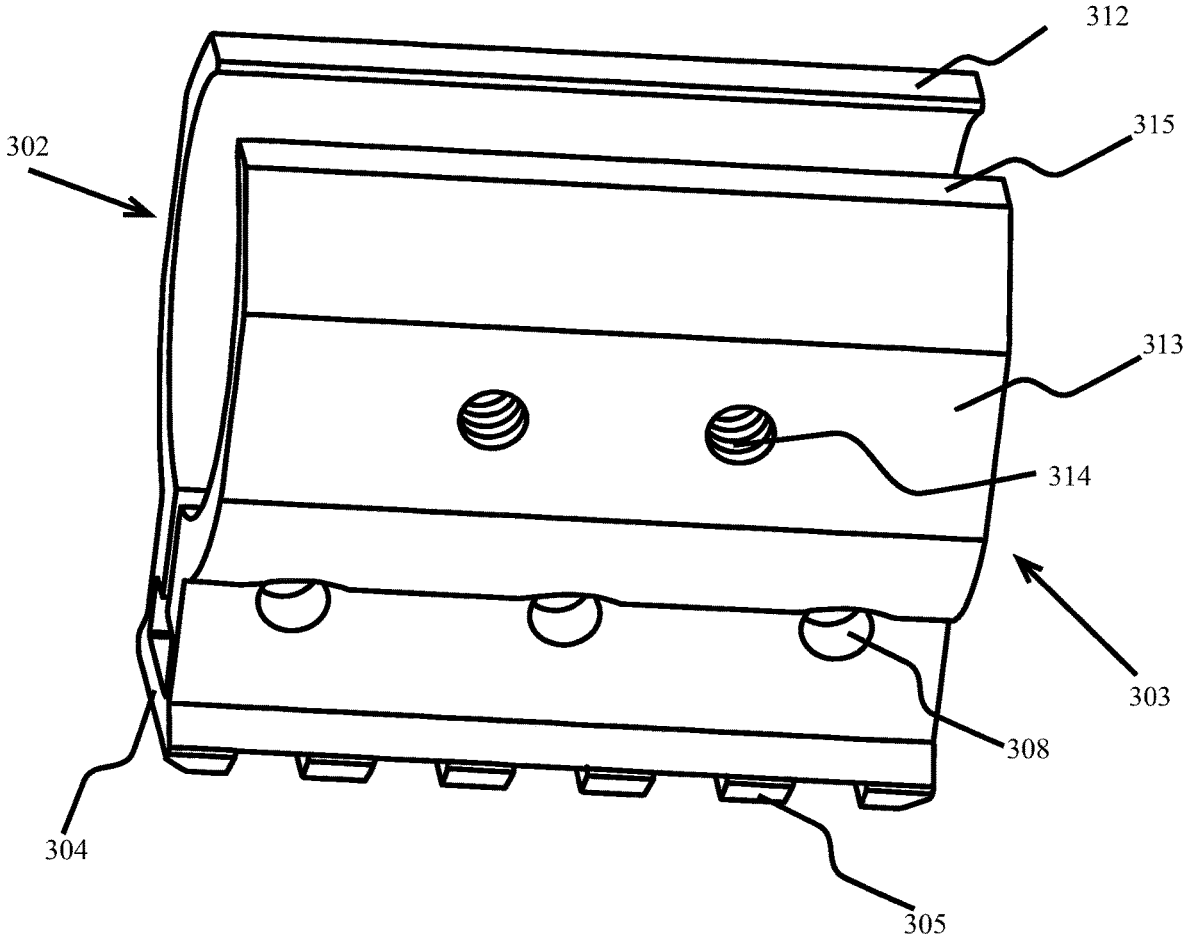
FIG. 5 illustrates the monolithic clamp body of FIG. 3 from the right and above in accordance with aspects of the embodiments.

FIG. 5 illustrates the monolithic clamp body 301 of FIG. 3 from the right and above in accordance with aspects of the embodiments. In this view, it can be seen that the right leg is illustrated with three clear holes 308. A clear hole is a hole through which a fastener, such as a screw, can slide. The threads in the right flat mounting holes 314 are also clearly visible.

Figure 6:
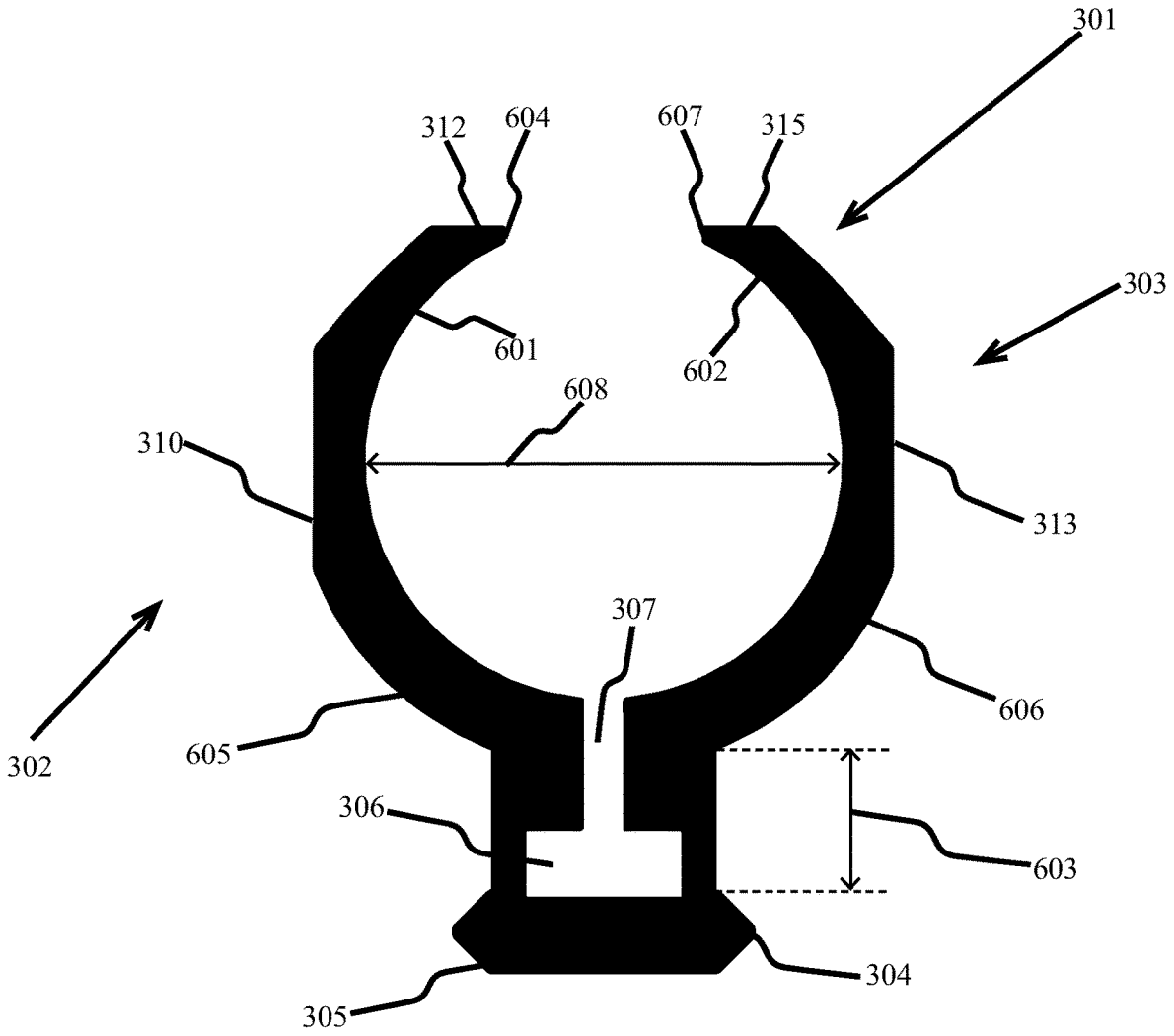
FIG. 6 illustrates an extrusion profile of the monolithic clamp body of FIG. 3, in accordance with aspects of the embodiments.

FIG. 6 illustrates an extrusion profile of the monolithic clamp body of FIG. 3, in accordance with aspects of the embodiments. The left jaw has a left leg, a left arc 605 and a left end 604. The left arc terminates at the left end 604. The right jaw 303 has a right leg and a right arc 606 terminating in a right end 607. The left end 604 and the right end 607 are separated by a top gap. The left leg and the right leg have a leg height 603. The left arc 605 has a left inner curve 601. The right arc 606 has a right inner curve 602. The left inner curve 601 and the right inner curve 602 can be sections of a circle, also called circular arcs. The left arc 605 and the right arc 606 have a diametrical separation 608 that is greater than the diameter of the air cylinder when the monolithic clamp body 301 is relaxed. As such, the monolithic clamp body 301 can be slid onto the air cylinder and then clamped onto the air cylinder. The monolithic clamp body 301 is configured to be clamped onto an air cylinder when the monolithic clamp body 301 can slide onto the air cylinder and can be clamped onto the air cylinder.

Figure 7:
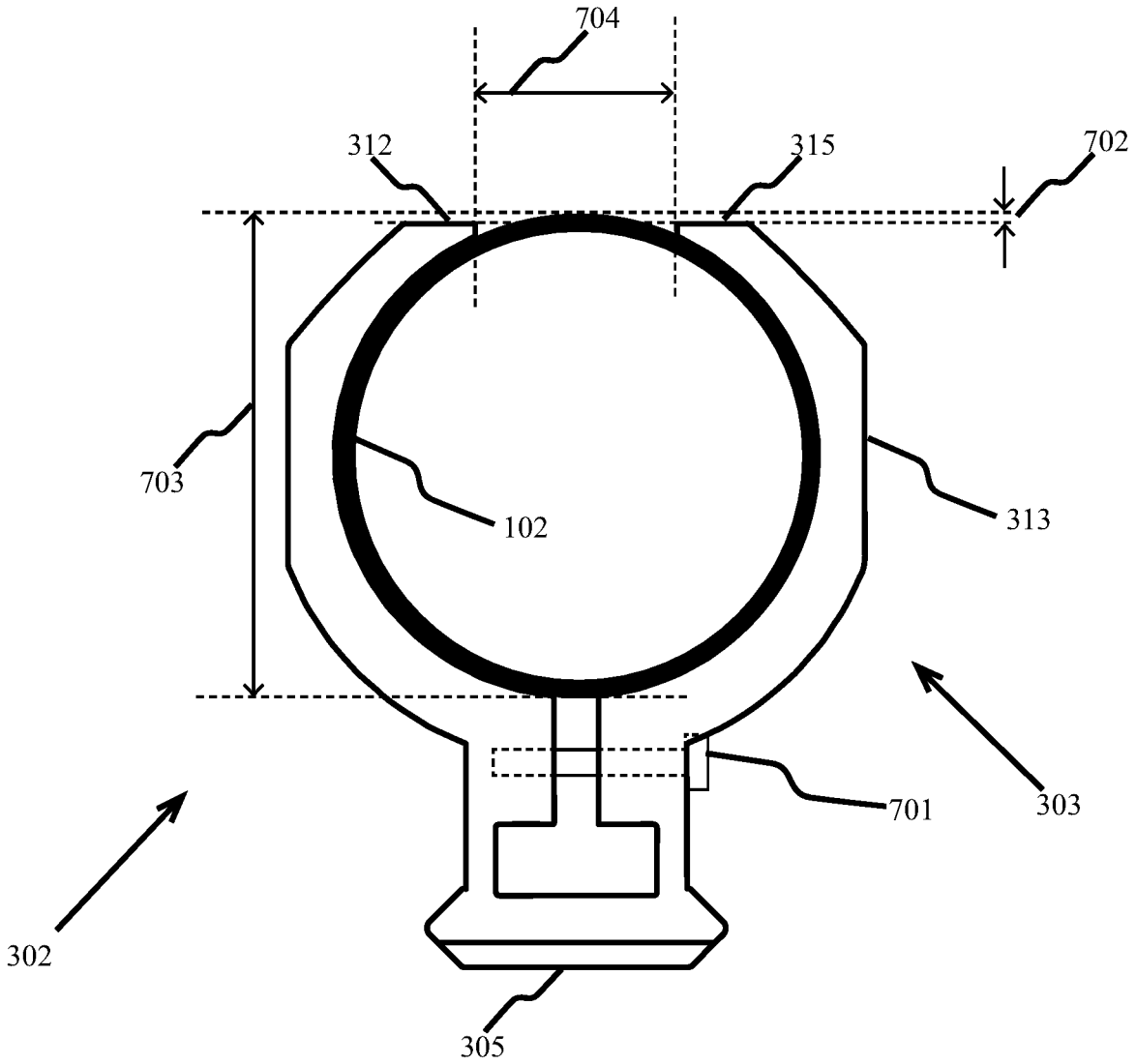
FIG. 7 illustrates the monolithic clamp body of FIG. 3 from behind and clamped on an air cylinder, in accordance with aspects of the embodiments.

FIG. 7 illustrates the monolithic clamp body 301 of FIG. 3 from behind and clamped on an air cylinder 102, in accordance with aspects of the embodiments. The cylinder diameter 703 of the air cylinder 102 is less than the diametrical separation 608 of the left arc 605 and the right arc 606 when the monolithic clamp body 301 is relaxed. In FIG. 7, the monolithic clamp body 301 is not relaxed because a clamp actuator 701 is causing the top gap 704 to narrow. The top gap 704 narrows when the left jaw 302 and the right jaw 303 are drawn together. The clamp actuator 701 is illustrated as a screw that passes through the clear hole 308 and is threaded into the threaded hole 309. Tightening the screw causes the jaws to tighten on the air cylinder. Recalling that FIGS. 1-5 indicate three clear holes 308 and three threaded holes 309, the clamp actuator can comprise three screws passing through the three clear holes 308 and threaded into the three threaded holes 309. Note that a padding or gasketing material can be applied to the inside surfaces of the monolithic clamp body 301 or to the outside surface of the air cylinder 102 to improve the fit of the left cylindrical sector 601 and the right cylindrical sector 602 to the air cylinder 102. Examples of the padding or gasketing material include vinyl tape, plastic tape, or foam tape. When the extrusion profile is extruded or pulled to form a solid body, the left inner curve 601 becomes the left cylindrical sector and the right inner curve 602 becomes the right cylindrical sector. A top clearance 702 is the distance by which the air cylinder 102 extends above the topmost part of the monolithic clamp body 301. Here, the topmost part of the monolithic clamp body 301 is the left top flat 312 and the right top flat 315.

Figure 8:
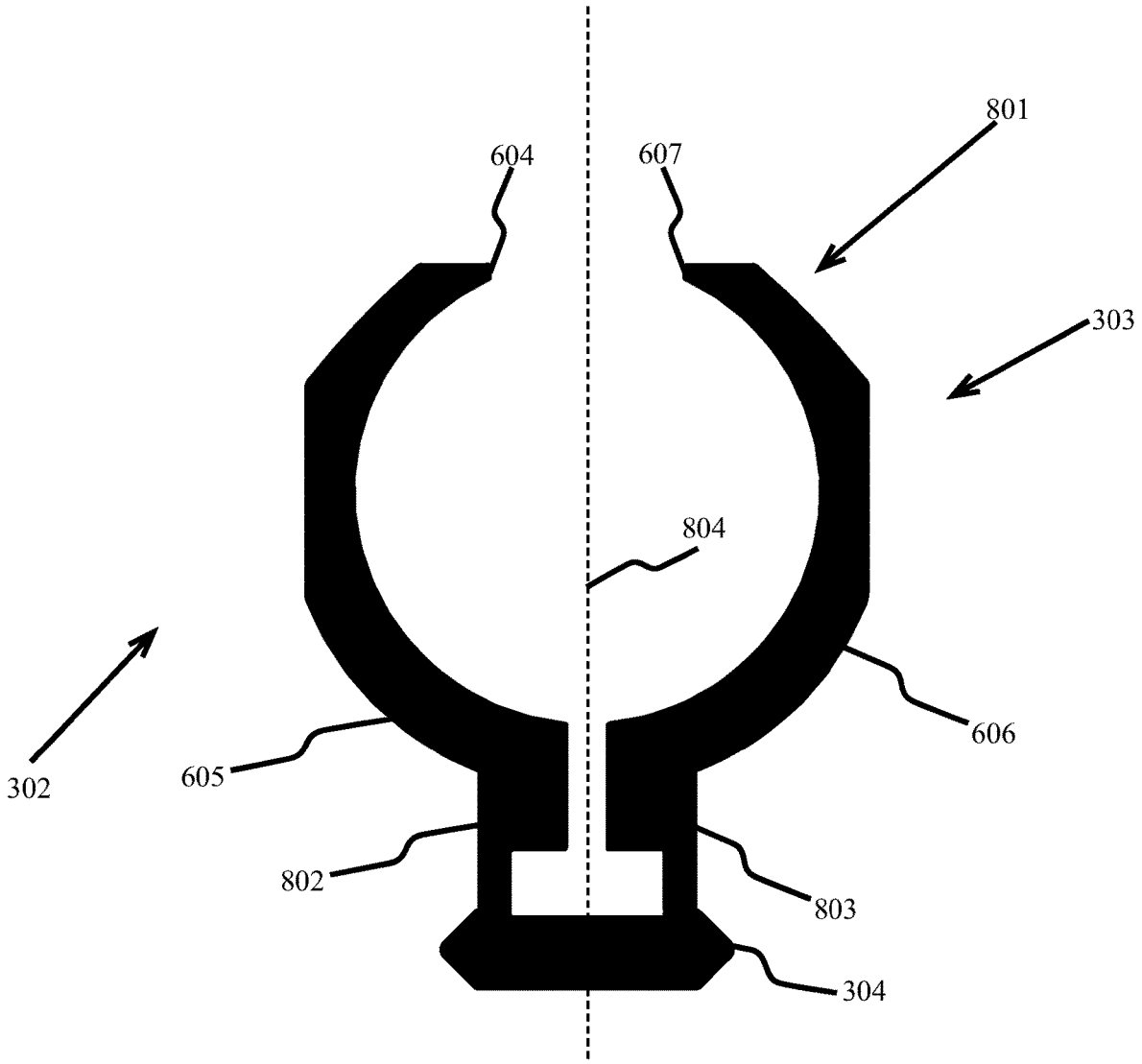
FIG. 8 illustrates an extrusion profile of the monolithic clamp body of FIG. 3, in accordance with aspects of the embodiments.

FIG. 8 illustrates an extrusion profile 801 of the monolithic clamp body 301 of FIG. 3, in accordance with aspects of the embodiments. As discussed herein, parts of an extrusion profile can have the same names as the parts of a solid body having the extrusion profile. The left jaw 302 has a left leg 802, a left arc 605, and terminates at the left end 604. The right jaw 303 has a right leg 803, a right arc 606, and terminates at the right end 607. The left leg 802 is attached to the base 304 and the left arc 605 is attached to the left leg 802 with the left arc 605 terminating at the left end 604. The right leg 803 is attached to the base 304, the right arc 606 is attached to the right leg 803, with the right arc 606 terminating at the right end 607. A vertical axis 804 is a line between the left leg 302 and right leg 303. The extrusion profile 801 of FIG. 8 is symmetric about the vertical axis 804. The top flats 312, 315 are perpendicular to the vertical axis 804. The left flat 310 and the right flat 313 are parallel to the vertical axis 804.

Figure 9:
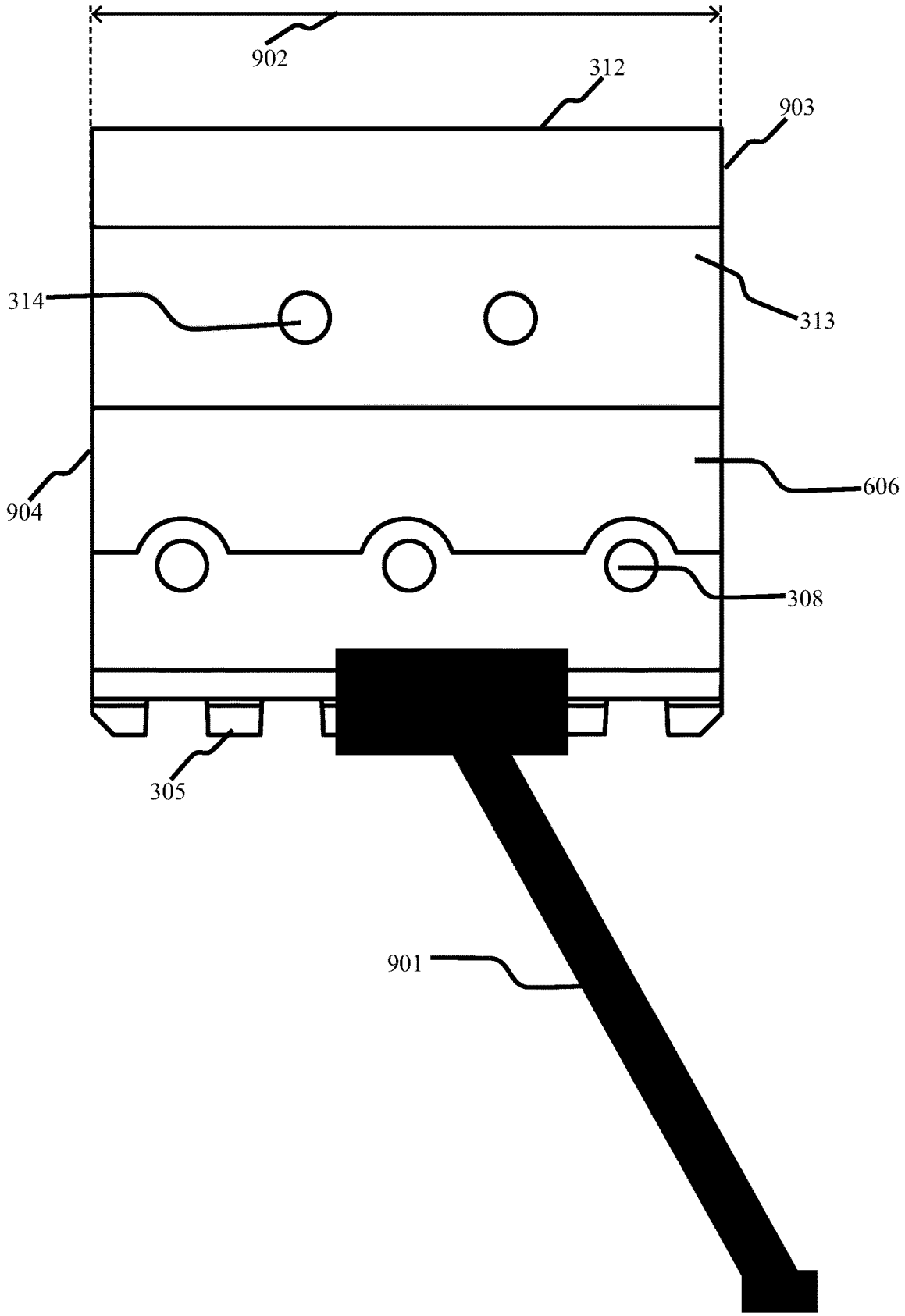
FIG. 9 illustrates the monolithic clamp body of FIG. 3 from the right with a bipod attached, in accordance with aspects of the embodiments.

FIG. 9 illustrates the monolithic clamp body 301 of FIG. 3 from the right with a bipod 901 attached, in accordance with aspects of the embodiments. The monolithic clamp body 301 has a length 902 that is the distance from the front end 903 of the monolithic clamp body 301 to the back end 904 of the monolithic clamp body 301. The bipod 901 can be any of the commercially available bipods that attach to a Picatinny rail.

Figure 10:
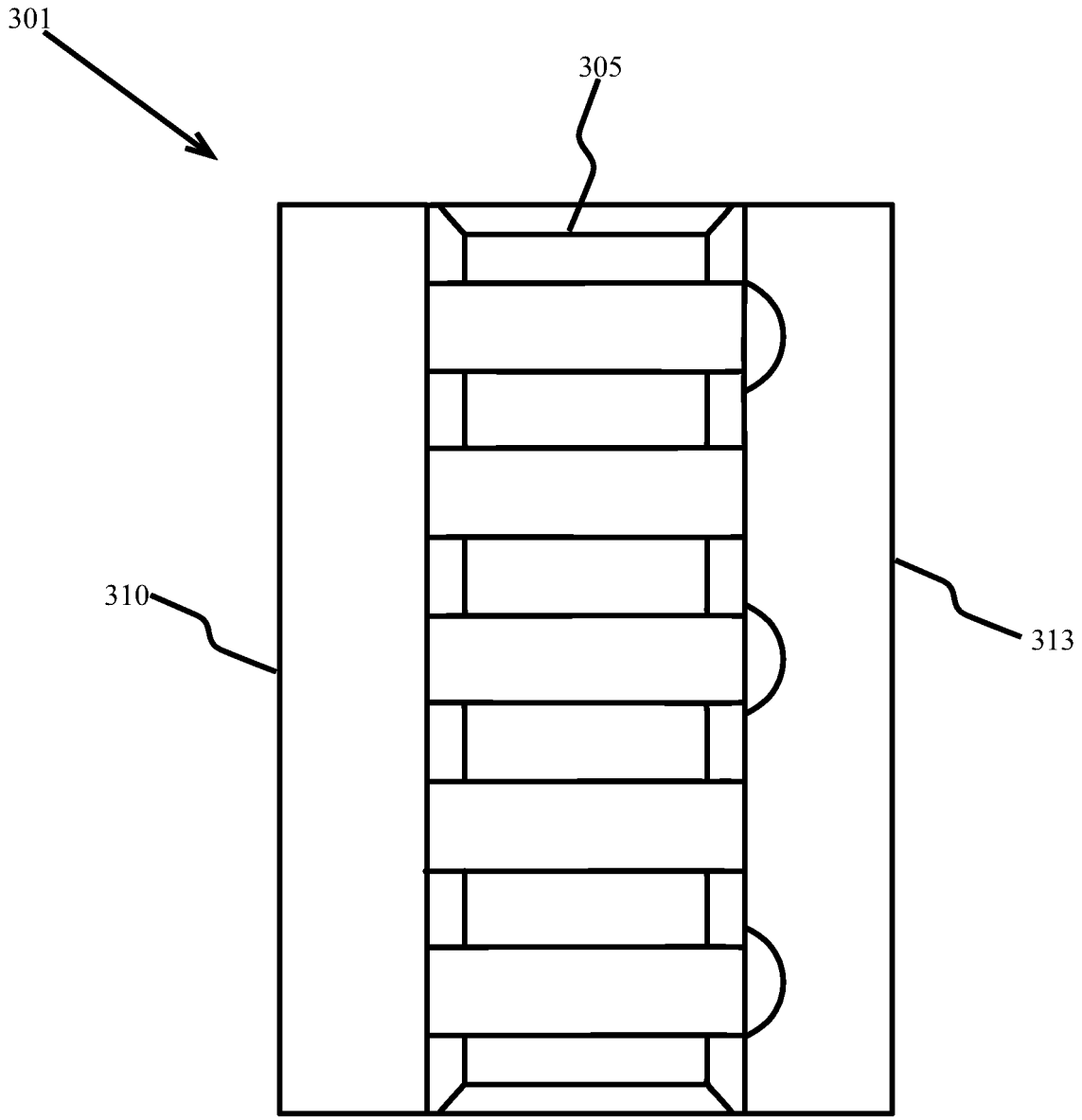
FIG. 10 illustrates the monolithic clamp body of FIG. 3 from below, in accordance with aspects of the embodiments.

FIG. 10 illustrates the monolithic clamp body of FIG. 3 from below, in accordance with aspects of the embodiments. In the embodiment illustrated in FIG. 10, the mounting rail 305 can be clearly seen to be a Picatinny rail.

Figure 11:
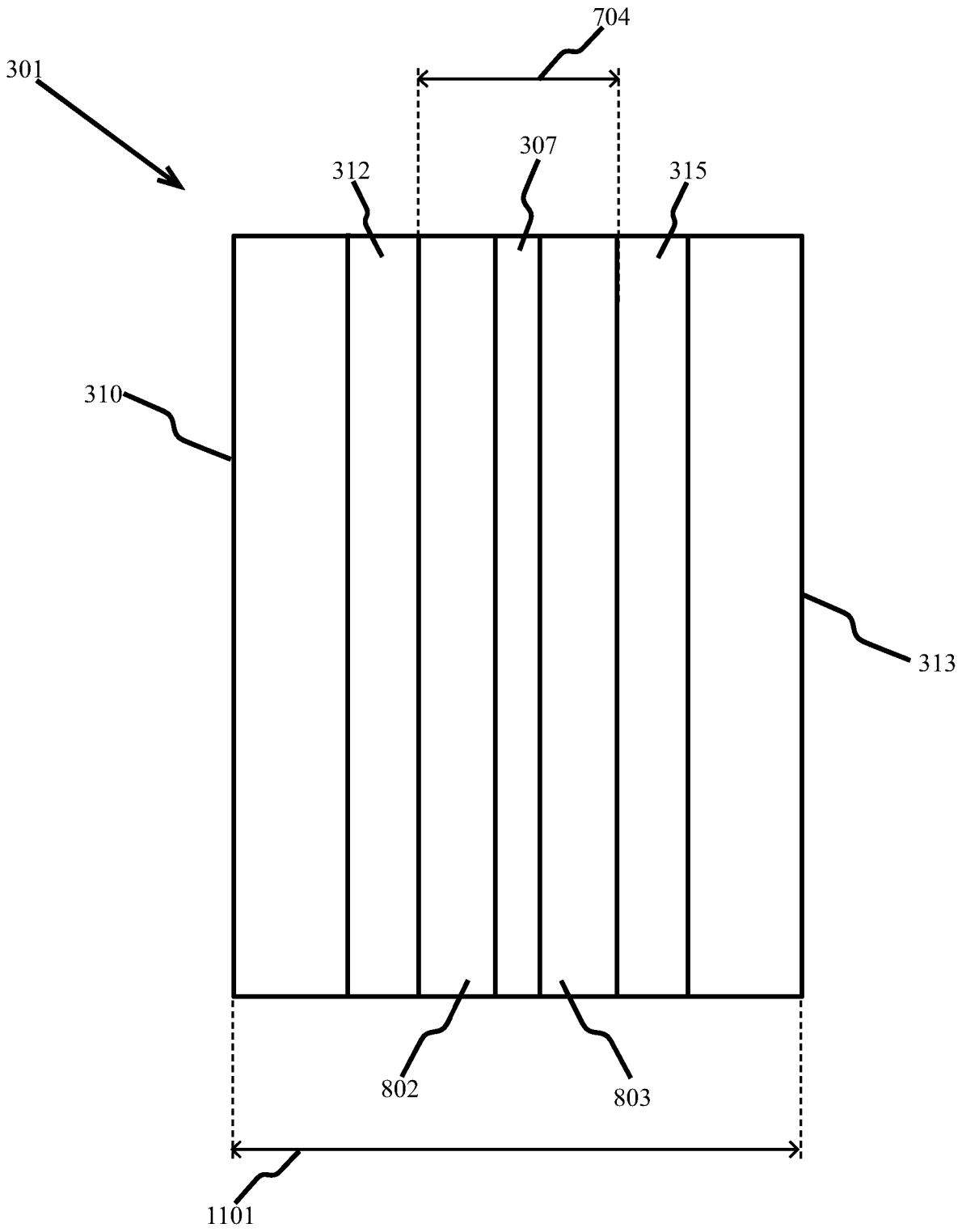
FIG. 11 illustrates the monolithic clamp body of FIG. 3 from above, in accordance with aspects of the embodiments.

FIG. 11 illustrates the monolithic clamp body of FIG. 3 from above, in accordance with aspects of the embodiments. The lower slot 307 can be seen between the left leg 802 and the right leg 803. The top gap 704 can be seen between the left end 312 and the right end 315. The body width 1101 is the width of the monolithic clamp body 301. In the illustrated embodiment, the body width 1101 is the distance between the left flat 310 and the right flat 313.

The embodiments shown in the figures and described herein are examples of an apparatus that can provide flexibility and convenience to air rifles by adding a mounting rail to which accessories, such as a bipod, can be attached. The apparatus can include a monolithic clamp body for clamping the mounting rail to an air cylinder of an air rifle. The apparatus can also include and a means for tightening the monolithic clamp body on an air cylinder. For example, the screw of FIG. 7 that passes through the clear hole 308 and is threaded into the threaded hole 309 is but one means for tightening the monolithic clamp body on the air cylinder. Tightening the monolithic clamp body on the air cylinder results in clamping the monolithic clamp body, and thereby the mounting rail, to an air cylinder It will be appreciated that variations of the above-disclosed and other features and functions, or alternatives thereof, may be desirably combined into many other different systems or applications. Also, that various presently unforeseen or unanticipated alternatives, modifications, variations or improvements therein may be subsequently made by those skilled in the art which are also intended to be encompassed by the following claims.

The invention claimed is:

1. A system comprising:

a monolithic clamp body comprising a left jaw, a right jaw, a base, and a mounting rail, wherein the monolithic clamp body is configured to clamp the mounting rail to an air cylinder of an air rifle, the air cylinder having a cylinder diameter;

a clamp actuator configured to tighten the monolithic clamp body on the air cylinder of the air rifle;

wherein the left jaw comprises a left leg, a left arc, and a left end, the left leg attached to the base, the left arc attached to the left leg, and the left arc terminating at the left end;

wherein the right jaw comprises a right leg, a right arc, and a right end, the right leg attached to the base, the right arc attached to the right leg, and the right arc terminating at the right end;

wherein a lower slot is between the left leg and the right leg;

wherein a top gap is between the left end and the right end; and wherein a diametrical separation between the left arc and the right arc is greater than the cylinder diameter.

2. The system of claim 1 wherein the clamp actuator comprises a screw that passes through a clear hole in the right leg and is threaded into a threaded hole in the left leg, wherein tightening the screw causes the top gap to narrow.

3. The system of claim 1 wherein the base comprises the mounting rail.

4. The system of claim 3 wherein the mounting rail is a picatinny rail.

5. The system of claim 1 wherein the monolithic clamp body comprises an extrusion profile that is symmetric about a vertical axis.

6. The system of claim 1 wherein an extrusion profile of the monolithic clamp body comprises a left top flat and a right top flat that are perpendicular to a vertical axis.

7. The system of claim 1 wherein an extrusion profile of the monolithic clamp body comprises a left flat and a right flat that are parallel to a vertical axis.

8. The system of claim 1 further comprising a bipod attached to the mounting rail.

9. The system of claim 8:

wherein the clamp actuator comprises a screw that passes through a clear hole in the right leg and is threaded into a threaded hole in the left leg;

wherein tightening the screw causes the top gap to narrow;

wherein the base comprises the mounting rail;

wherein the mounting rail is a picatinny rail;

wherein the monolithic clamp body comprises an extrusion profile that is symmetric about a vertical axis;

wherein the extrusion profile comprises a left top flat and a right top flat that are perpendicular to the vertical axis and configured to be below a top surface of the air cylinder;

wherein the extrusion profile comprises a left flat and a right flat that are parallel to the vertical axis;

wherein the left flat and the right flat comprises a plurality of threaded mounting holes;

wherein the top gap is diametrically opposed to the base;

wherein the monolithic clamp body comprises a left cylindrical sector and a right cylindrical sector diametrically opposed to the left cylindrical sector;

wherein tightening the screw draws the left cylindrical sector and the right cylindrical sector into contact with the air cylinder.

10. An apparatus comprising:

a monolithic clamp body for clamping a mounting rail to an air cylinder of an air rifle, the monolithic clamp body comprising a mounting rail; and a means for tightening the monolithic clamp body on an air cylinder;

wherein the monolithic clamp body comprises a top gap diametrically opposed to a base comprising the mounting rail;

wherein the monolithic clamp body comprises a left cylindrical sector and a right cylindrical sector diametrically opposed to the left cylindrical sector;

wherein tightening the means for tightening the monolithic clamp body on the air cylinder draws the left cylindrical sector and the right cylindrical sector into contact with the air cylinder.

11. The apparatus of claim 10 wherein the mounting rail is a picatinny rail.

12. The apparatus of claim 10 wherein the means for tightening the monolithic clamp body on the air cylinder comprises a screw that passes through a clear hole and is threaded into a threaded hole, wherein tightening the screw causes the top gap to narrow.

13. The apparatus of claim 10 wherein the monolithic clamp body comprises an extrusion profile that is symmetric about a vertical axis.

14. The apparatus of claim 13 wherein the extrusion profile comprises a left top flat and a right top flat that are perpendicular to the vertical axis.

15. The apparatus of claim 13 wherein the extrusion profile comprises a left flat and a right flat that are parallel to the vertical axis.

16. A system comprising:

a monolithic clamp body comprising a mounting rail, an extrusion profile and a length wherein the monolithic clamp body is configured to clamp the mounting rail to an air cylinder of an air rifle, the air cylinder having a cylinder diameter;

a clamp actuator configured to tighten the monolithic clamp body on the air cylinder of the air rifle;

wherein the extrusion profile comprises a left jaw, a right jaw, and a base;

wherein the left jaw comprises a left leg, a left arc, and a left end, the left leg attached to the base, the left arc attached to the left leg, and the left arc terminating at the left end;

wherein the right jaw comprises a right leg, a right arc, and a right end, the right leg attached to the base, the right arc attached to the right leg, and the right arc terminating at the right end;

wherein a lower slot is between the left leg and the right leg;

wherein a top gap is between the left end and the right end; and wherein a diametrical separation between the left arc and the right arc is greater than the cylinder diameter when the monolithic clamp body is relaxed.

17. The system of claim 16 wherein the extrusion profile is symmetric about a vertical axis.

18. The system of claim 17 wherein a left inner curve of the left leg is a section of a circle.

19. The system of claim 17 wherein the extrusion profile comprises a left top flat and a right top flat that are perpendicular to the vertical axis and configured to be below a top surface of the air cylinder.

20. The system of claim 16 wherein the clamp actuator comprises a screw, wherein tightening the screw causes the top gap to narrow.

* * * * *